US008215024B1

(12) United States Patent
Terzo

(10) Patent No.: US 8,215,024 B1
(45) Date of Patent: Jul. 10, 2012

(54) SIGHTING DEVICE FOR A WEAPON

(76) Inventor: Michael Terzo, Missoula, MT (US)

( * ) Notice: Subject to any disclaimer, the term of this patent is extended or adjusted under 35 U.S.C. 154(b) by 1437 days.

(21) Appl. No.: 11/787,492

(22) Filed: Apr. 16, 2007

Related U.S. Application Data

(60) Provisional application No. 60/744,924, filed on Apr. 15, 2006.

(51) Int. Cl.
*F41G 1/00* (2006.01)
*F41G 1/467* (2006.01)

(52) U.S. Cl. ..... 33/265; 124/87; 42/130; 33/297

(58) Field of Classification Search ..... 33/265, 33/297, 298; 124/87; 42/111, 113, 130–132
See application file for complete search history.

(56) References Cited

U.S. PATENT DOCUMENTS

| | | | | |
|---|---|---|---|---|
| 4,764,011 | A * | 8/1988 | Goldstein | 356/251 |
| 5,383,278 | A * | 1/1995 | Kay | 33/265 |
| 5,653,034 | A * | 8/1997 | Bindon | 42/131 |
| 5,894,672 | A | 4/1999 | Ellenburg et al. | |
| 6,601,966 | B1 | 8/2003 | Wiklund et al. | |
| 6,807,742 | B2 * | 10/2004 | Schick et al. | 33/297 |
| 6,817,105 | B2 | 11/2004 | LoRocco | |
| 7,100,291 | B2 | 9/2006 | Afshari | |
| 7,100,292 | B2 | 9/2006 | Afshari | |
| 7,159,325 | B2 | 1/2007 | Rager | |
| 7,200,943 | B2 | 4/2007 | Afshari | |
| 7,814,669 | B2 * | 10/2010 | Kingsbury | 33/265 |

* cited by examiner

*Primary Examiner* — Amy Cohen Johnson
(74) *Attorney, Agent, or Firm* — Jean Kyle

(57) ABSTRACT

A sighting device for a weapon has a light gathering fiber optic that projects an image onto a partially reflective optical lens which reflects the image back to the shooter. The lens has a reticle to allow the shooter to align the image on the lens and sight the device onto the target.

19 Claims, 5 Drawing Sheets

SIGHTING DEVICE FOR A WEAPON

CROSS-REFERENCE TO RELATED APPLICATIONS

This application claims the benefits of U.S. Provisional Application No. 60/744,924, filed Apr. 15, 2006, the disclosure of which is hereby incorporated by reference in its entirety including all figures, tables and drawings.

BACKGROUND OF THE INVENTION

A sighting device placed on any projectile-type weapon increases the accuracy and precision of that weapon. Single beads on a shotgun, front and rear sights on a rifle as well as scopes on a rifle have been used for years. Likewise, sights have been used on archery bows for years but sight choices for archery have continued to evolve and change. A common sight used by archers includes pins set to help aim the bow at a target at varying distances. The pins are viewed through a peep sight positioned in the bow string and placed on the target. The rear peep sight can be difficult for some to use and slows the speed of the bow string which slows arrow speed. Many new devices have been developed in an attempt to perfect an archery sight (see, for example, U.S. Pat. Nos. 5,894,672; 6,817,105; 7,100,291; 7,100,292; 7,159,325; and 7,200,943). A need remains however for a sight for a projectile-type weapon that is simple, easy to use and does not encumber the weapon.

All patents, patent applications, provisional patent applications and publications referred to or cited herein, are incorporated by reference in their entirety to the extent they are not inconsistent with the teachings of the specification.

SUMMARY OF THE INVENTION

A sighting device for an archery bow has one or more light gathering optical fibers mounted near the rear of the device. A partially reflective optical lens mounted on a forward portion of the device reflects the image from the fiber optic strand. The optical lens is enhanced with a reticle. The sight of the subject invention allows a user of a projectile weapon to align the projected image of the fiber optic strand with a portion of the lens reticle and sight the device onto a target without the use of further sighting devices.

DETAILED DESCRIPTION OF THE INVENTION

Figure 1:
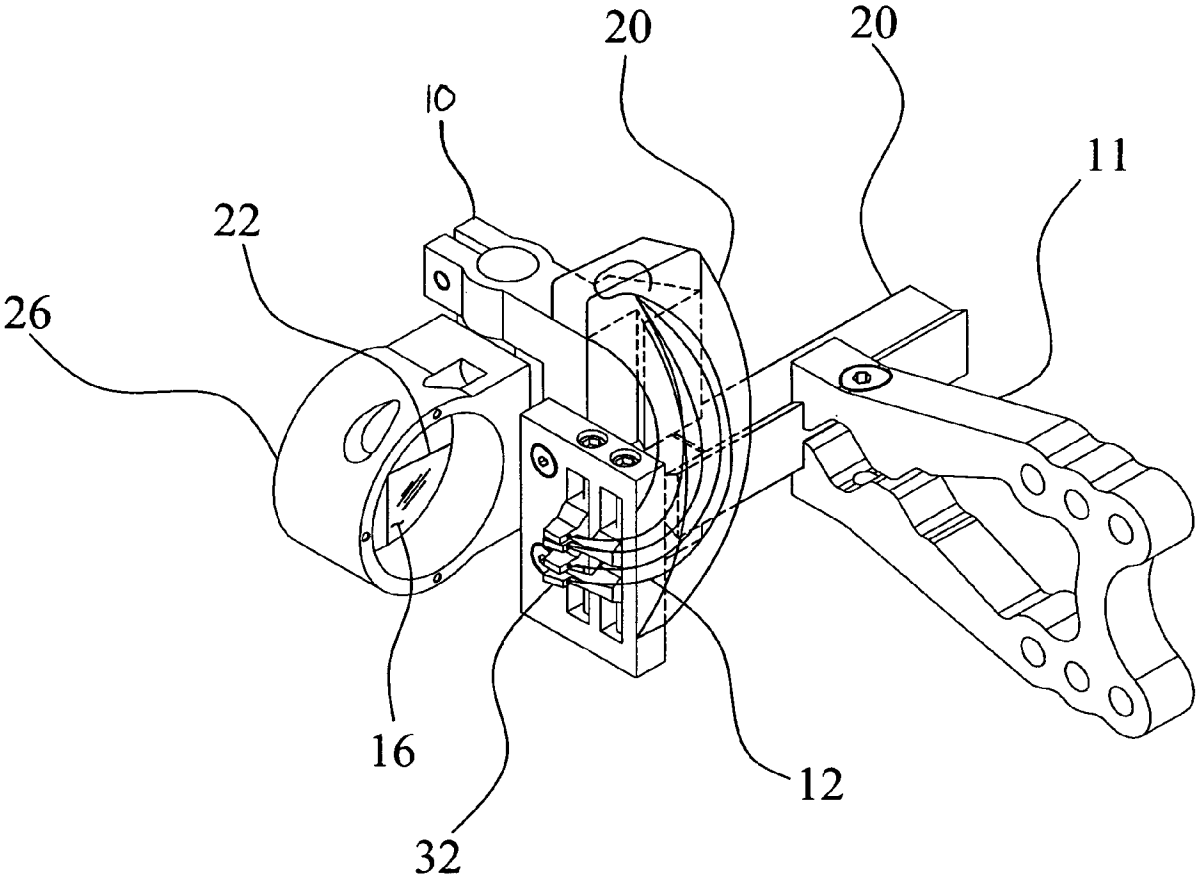
FIG. 1 is a perspective view of a preferred embodiment of the sighting device of the subject invention.
Figure 2:
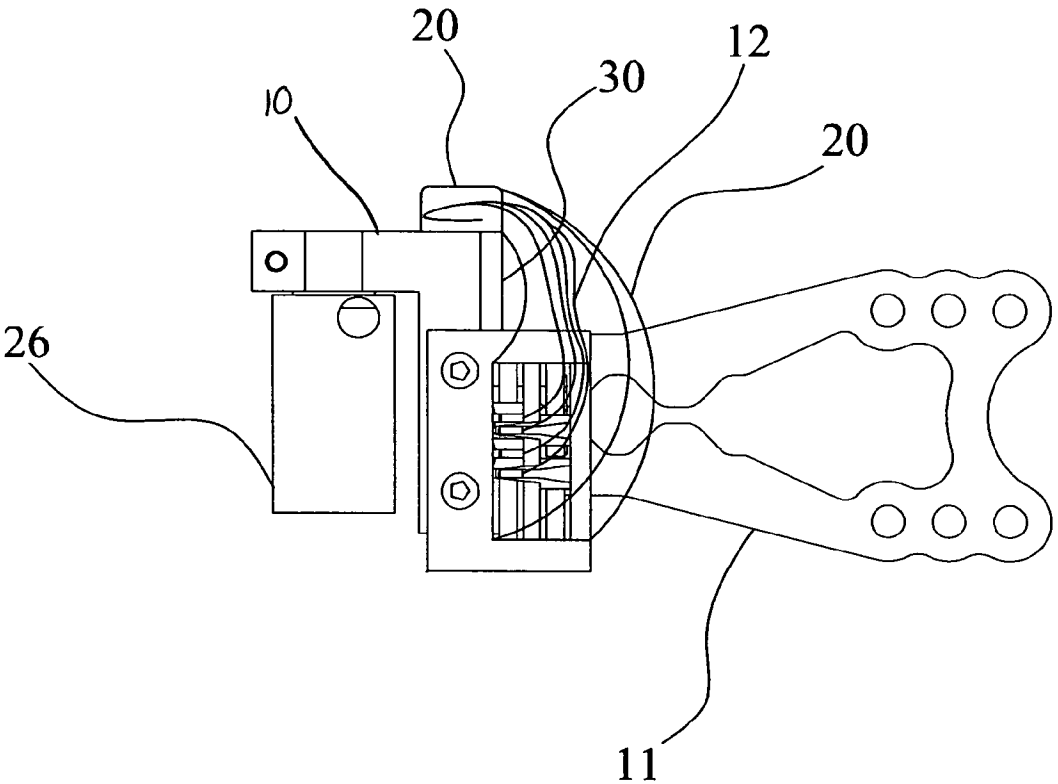
FIG. 2 is a side elevational view of the sighting device shown in FIG. 1.
Figure 3:
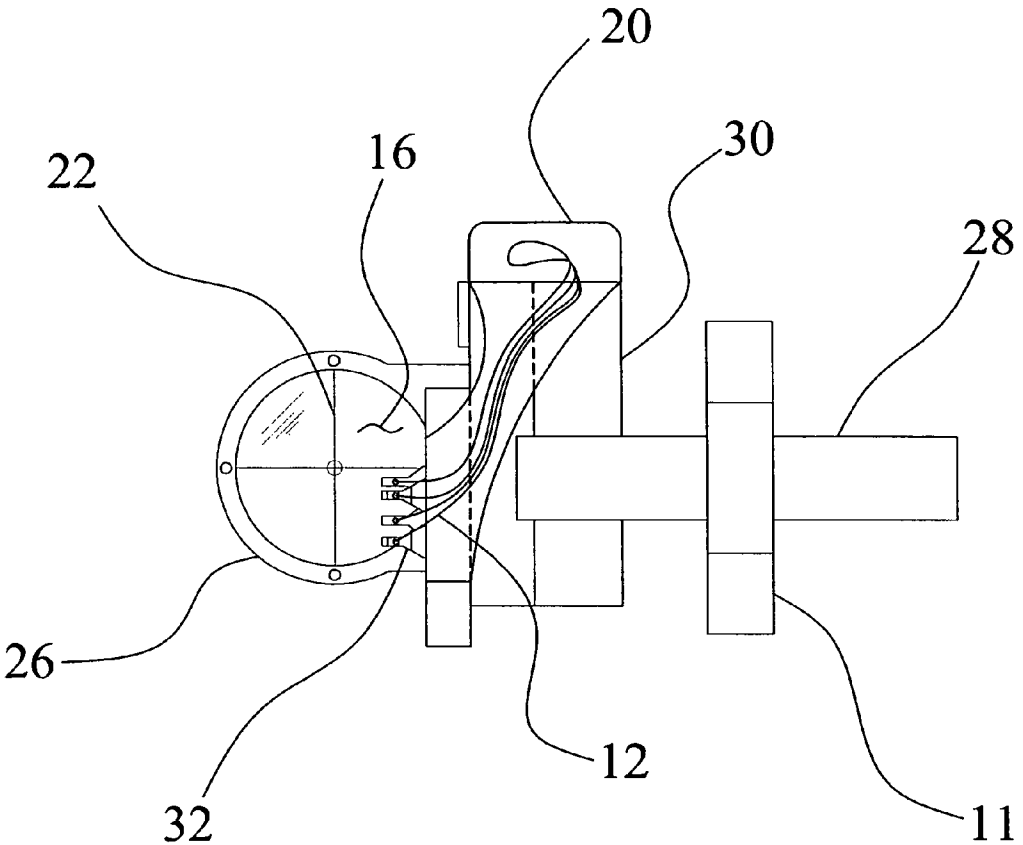
FIG. 3 is a rear elevational view of the sighting device shown in FIG. 1.
Figure 4:
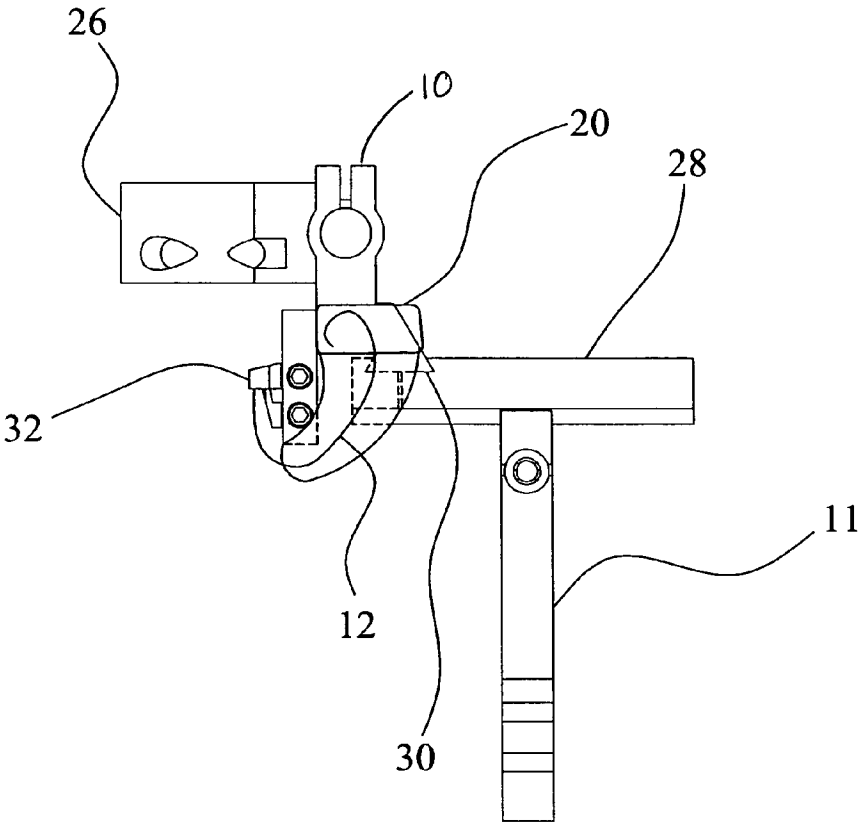
FIG. 4 is a top plan view of the preferred embodiment of the sighting device shown in FIG. 1.

The sighting device of the subject invention has at least one fiber optic strand positioned near one end of a sight body. A partially reflective optic lens whose terminal end is positioned opposite the terminal end of the fiber optic strand reflects an image of the fiber optic strand to the eye of the shooter. The shooter aligns the fiber optic image with a reticle on the lens and then positions the aligned images onto the target. The sight of the subject invention alleviates the need for additional sighting devices, such as, a string mounted peep sight on a bow.

The exemplified embodiment of the sight of the subject invention shows a sighting device suitable for use on an archery bow or cross-bow. It is noted however that the subject sight can be used on any projectile-type device including, but not limited to, rifles, slingshots, and shotguns.

A preferred embodiment of the sight of the subject invention is shown in FIGS. 1-4. In this embodiment, a bracket 11 supports the subject device and mounts it to a bow. The sight body 10 has a terminal end of at least one fiber optic strand 12 near one end 14 of the body and a partially reflective optic lens 16 at another end 18. The fiber optic strand 12 captures light to project an image from its terminal end onto the partially reflective optic lens 16. The longer the fiber optic strand 12 the more light it gathers and the brighter that image. In the embodiment shown, the fiber optic strand is encased in a housing 20 to protect it from being snagged or displaced. The housing 20 can be clear or translucent to allow the strand to capture light along its length.

A lens suitable for use on the subject sight is described in U.S. Pat. No. 6,601,966 B1. The lens is coated on one side with a partially reflective layer which reflects light in a desired wavelength. The other side of the lens is preferably coated with an anti-reflecting layer to avoid reflection of the target.

The optical lens 16 has a reticle 22. The reticle provides a second point of reference for the sighting device. The reticle can be a simple vertical line, a series of parallel vertical lines, a simple horizontal line, a series parallel horizontal lines or a cross-hair. The reticle can be further enhanced by a circular line. The reticle can be positioned center or off-center on the optical lens depending upon the focal point of the lens.

Figure 5:
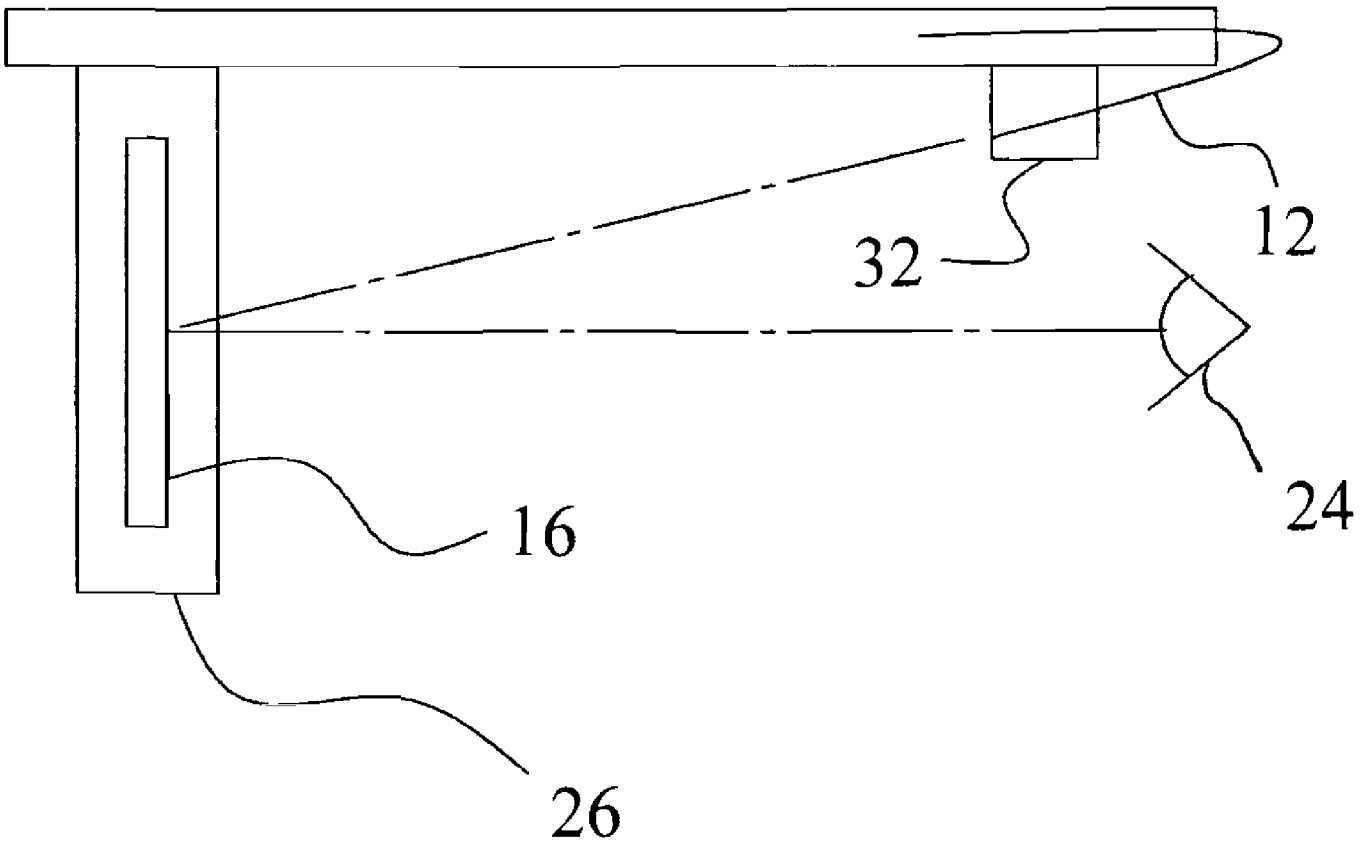
FIG. 5 is an illustrative view of the line of sight for a shooter using the sighting device of the subject invention.

The body 10 of the subject device provides sufficient distance for the image from the fiber optic strand to be reflected off the optic lens 16 to the eye of the shooter 24 (FIG. 5). The lens 16 can be mounted to the body 10 by a lens mounting bracket 26 or the lens can be integral with the body. In a preferred embodiment, the device further comprises a means to adjust the pins for windage 28 and a means to adjust the pins for elevation 30. Many sighting devices have such means and one skilled in the art is familiar with and would be able to apply them to the sighting device of the subject invention.

In a particularly preferred embodiment, the device has several fiber optic strands placed in pins 32 set for sighting the weapon at varying distances. Each pin 32 can be provided with its own color of fiber optic strand. For example, a green fiber optic strand can be positioned in the 20 yard, top, pin, a red fiber optic strand can be strand in the 30 yard pin, a yellow fiber optic strand in the 40 yard pin and an orange fiber optic strand in the 60 yard pin. The shooter after estimating the projected distance to the target uses the image projected from the proper pin to sight the weapon on the target.

In use, the shooter aligns the proper image projected from the fiber optic strand, typically a colored dot, with the reticle on the optic lens then positions the aligned images on the target. As mentioned previously, the shooter must know the approximate distance to the target and will be required to properly adjust the sighting device on the weapon to achieve accuracy. This is necessary and expected with all sighting devices.

It is understood that the foregoing examples are merely illustrative of the present invention. Certain modifications of the articles and/or methods may be made and still achieve the objectives of the invention. Such modifications are contemplated as within the scope of the claimed invention.

The invention claimed is:

1. A sighting device for a weapon comprising:

a sight body;

at least one fiber optic strand comprising a terminal end; and a partially reflective lens disposed on the body opposite the terminal end of the at least one fiber optic strand, the lens comprising a reticle and reflecting an image projected from the terminal end of the at least one fiber optic strand to a user;

whereby the user aims the weapon at a target by aligning the reflected image of the terminal end of the at least one fiber optic strand with the reticle on the lens and positions the aligned images on the target.

2. The sighting device of claim 1, wherein said reticle is at least one horizontal line.

3. The sighting device of claim 1, wherein said reticle is at least one vertical line.

4. The sighting device of claim 1, wherein said reticle is a cross-hair.

5. The sighting device of claim 1, wherein said reticle is a circle.

6. The sighting device of claim 1, wherein said reticle is a cross-hair and a circle.

7. The sighting device of claim 1, wherein said reticle is off-center on said lens.

8. The sighting device of claim 1, further comprising a housing encasing said at least one fiber optic strand.

9. The sighting device of claim 1, wherein said terminal end of said at least one fiber optic strand is disposed in a pin.

10. The sighting device of claim 1, wherein said device comprises at least two fiber optic strands each comprising terminal ends.

11. The sighting device of claim 10, wherein said terminal ends of said at least two fiber optic strands are each disposed in pins.

12. The sighting device of claim 1, further comprising a means to adjust the sighting device for elevation.

13. The sighting device of claim 1, further comprising a means to adjust the sighting device for windage.

14. The sighting device of claim 1, further comprising a means to adjust the sighting device for windage and elevation.

15. A sighting device for a weapon comprising:

a sight body;

at least one fiber optic strand comprising a terminal end; and a partially reflective lens disposed on the body opposite the terminal end of the at least one fiber optic strand, the lens comprising a reticle which is a cross-hair and reflecting an image projected from the terminal end of the at least one fiber optic strand to a user;

whereby the user aims the weapon at a target by aligning the reflected image of the terminal end of the at least one fiber optic strand with the reticle on the lens and positions the aligned images on the target.

16. The sighting device of claim 15, wherein said terminal end of said at least one fiber optic strand is disposed in a pin.

17. The sighting device of claim 15, comprising at least two fiber optic strands each comprising terminal ends each disposed in a pin.

18. The sighting device of claim 15, further comprising a means to adjust the sighting device for windage and elevation.

19. The sighting device of claim 15, wherein the reticle further comprises a circle.

* * * * *